United States Patent [19]

Becker et al.

[11] 4,176,811

[45] Dec. 4, 1979

[54] CONICAL YARN CARRIER

[76] Inventors: Josef Becker; Hubert Becker; Matthias Becker, all of Niederforstbacher Strasse 80-84, 5100 Aachen-Brand, Fed. Rep. of Germany

[21] Appl. No.: 920,545

[22] Filed: Jun. 29, 1978

[30] Foreign Application Priority Data

Jul. 8, 1977 [DE] Fed. Rep. of Germany ..... 2730875

[51] Int. Cl.[2] ..... B65H 75/10; B65H 75/20

[52] U.S. Cl. ..... 242/118.1

[58] Field of Search ..... 242/118.1, 118.11, 118.3; 68/198

[56] References Cited

U.S. PATENT DOCUMENTS

| | | | |
|---|---|---|---|
| 2,127,936 | 8/1938 | Pierce | 242/118.1 |
| 2,192,111 | 2/1940 | Vlaszac | 242/118.11 |
| 3,647,156 | 3/1972 | Henning | 242/118.1 |
| 4,078,740 | 3/1978 | Hahm et al. | 242/118.11 |

*Primary Examiner*—George F. Mautz

*Attorney, Agent, or Firm*—W. G. Fasse; D. F. Gould

[57] ABSTRACT

A conical yarn carrier comprises yarn supporting surfaces in the form of longitudinal rods which are held together by securing rings to form a cage having a circular cross section. Radially extending openings and longitudinally extending slots or channels are provided between the rods. These slots or channels extend lengthwise between adjacent yarn carrier rods and approximately from the middle of the yarn carrier axially to its upper edge and overlap with said openings. The yarn carrier further comprises a ring element located on the carrier surface forming rod. The ring element is axially displaceable within certain limits and comprises radially inwardly extending projections guided in the slots or channels.

5 Claims, 4 Drawing Figures

CONICAL YARN CARRIER

BACKGROUND OF THE INVENTION

The invention relates to a conical yarn carrier having carrier surfaces defined by a frustum jacket surface. Radially extending openings are arranged between the carrier surface forming means.

Different types of yarn carriers are known for taking up yarn type textile material. These prior art yarn carriers comprise a sleeve provided with perforations whereby the sleeve is formed by a cylindrical or frustum shaped jacket. Yarn carriers comprising a frustum shaped jacket have the advantage that they may be nested coaxially one within the other, whereby they require less space for transportation and storage. In addition, these frustum shaped yarn carriers have the advantage that they basically also permit the densification of the yarn type textile material which is necessary for a homogeneous treatment. However, concially constructed yarn carriers tend to move to such an extent one into the other until they are unreleasably jammed relative to each other. Such a jamming, however, must be avoided. Hence, it is necessary to limit the coaxial densification of a column formed of yarn carriers.

The limitation of the densification cannot be defined for each individual yarn carrier. Therefore, it is not possible to assure that the textile material is densified with sufficient uniformity over the entire height or length of the column. Thus, a lap creel of rod shaped carrier elements has been suggested heretofore for achieving a uniform densification of the wound-up yarn. In such a lap creel the carrier elements extend in parallel to the central axis of the lap creel. In addition, the carrier elements extend radially outwardly into a common cylindrical surface. The carrier elements are connected only to a so-called end ring which is provided with perforations which are substantially adapted to the cross section of the carrier elements. The number of the perforations corresponds to the number of the carrier elements so that the yarn carriers may be nested one within the other in a coaxial fashion. In addition to the end ring there are arranged so-called support rings which are distributed over the height or length of the carrier elements, whereby neighboring yarn carriers may be nested one within the other only to a limited extent. The nesting is limited because the ends of the carrier elements of one yarn carrier positioned opposite the end ring, butt against the support ring located closest to the end ring of the other lap creel or yarn carrier.

An essential disadvantage of the known construction is seen in that it is not possible to form a freely accessible thread reserve on the yarn carrier. Such a thread reserve or supply is used to connect, ahead of time, the end of the thread of one winding with the beginning of the thread of another winding. A thread supply cannot be formed at one end of the prior art yarn carrier because the end ring with its perforations is in the way. A thread reserve applied at the opposite end would slide off without any hindrance even if the ends of the carrier elements would not be rounded off.

OBJECTS OF THE INVENTION

In view of the above it is the aim of the invention to achieve the following objects singly or in combination:

- to construct a yarn carrier in such a manner that it may be inserted coaxially into another yarn carrier of the same construction to a definite proportion of its height or length;
- to construct the yarn carrier in such a manner that a freely accessible thread reserve may be formed and that such thread reserve is prevented from any unintended shifting;
- to construct a yarn carrier in such a manner that it makes possible an absolutely uniform densification of the individual yarn windings;
- to make sure that the extent to which individual yarn carriers may be nested one within the other, may be exactly limited;
- to avoid any hindrance of the nesting by the securing or holding rings and the stiffening ribs; and
- to construct the present yarn carrier in such a manner that it may be used without difficulties on standard automatic winding machines.

SUMMARY OF THE INVENTION

According to the invention there is provided a yarn carrier having carrier surfaces defined by a frustum jacket surface whereby radially extending opening and axially extending slots or channels are located between adjacent carrier surface means. The openings and slots overlap partially. The slots are uniformly distributed about the circumference of the yarn carrier and extend from the middle of the yarn carrier axially to its upper edge. The yarn carrier further comprises a ring element located on the carrier surface. The ring element is axially displaceable within limits and comprises radially inwardly extending projections guided in said slots.

The yarn carrier according to the invention assures an absolutely uniform densification of the individual yarn windings due to the fact that the axially movable ring element permits an exactly defined axial shifting. For the securing of the carrier element forming the carrier surfaces, it is not necessary to have an end ring protruding beyond the carrier elements. Therefore, the yarn carrier according to the invention provides a free winding surface all along its entire height or length. Thus, it is possible, especially on the end with the large diameter, to form a freely accessible thread reserve which cannot slide off the yarn carrier due to the conical shape of the carrier.

Surprisingly, a hindrance of the densification of a yarn lap located on the yarn carrier according to the invention, does not occur although the lap densifies exclusively from the end of the yarn carrier having the smaller diameter in the direction toward the end having the larger diameter. Actually, the conical shape of the yarn carrier according to the invention does not hinder the densification process because the diminishing slanted course of the lap layers which cross each other, causes a diameter increase of the individual lap layers.

BRIEF FIGURE DECRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
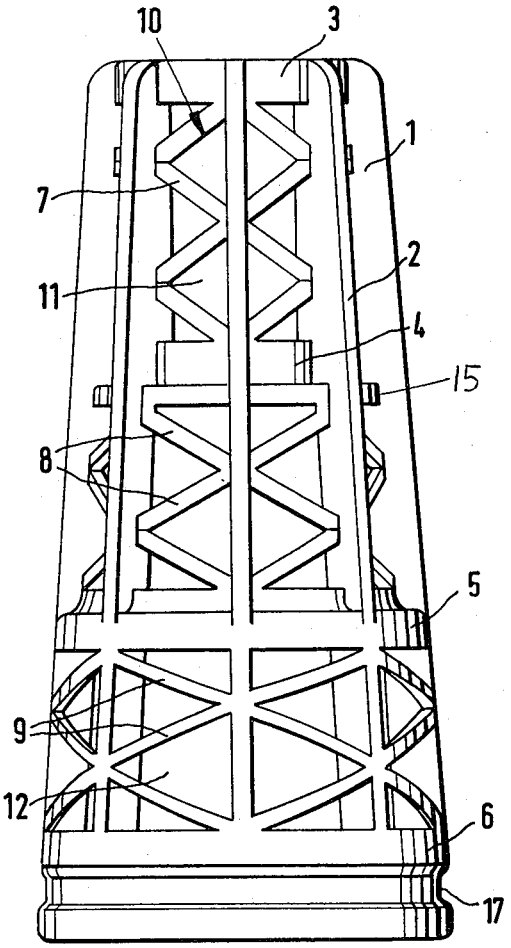
FIG. 1 is a side view of a yarn carrier according to the invention.

As shown in FIG. 1 the conical yarn carrier according to the invention comprises circularly arranged rods 1 having radially outwardly facing edges forming carrier surfaces 2 which are defined by the jacket surface of a frustum.

The rods 1 are held in position by means of horizontally arranged securing rings 3, 4, 5, and 6 as well as by stiffening ribs 7, 8, and 9 extending diagonally between the rods 1. The securing rings 3 and 4 as well as the stiffening ribs 7 and 8 are arranged in such a manner that the rods 1 extend radially outwardly relative to the just mentioned rings and ribs to thereby form a winding surface. The winding surface comprises openings 10 as well as slots or channels 11 between the rods 1. On the other hand, the securing rings 5 and 6 as well as the stiffening ribs 9 are arranged in such a manner that the rods 1 protrude radially inwardly. In this area between the rings 5 and 6, the winding surface is provided merely with perforations 12.

Figure 2:
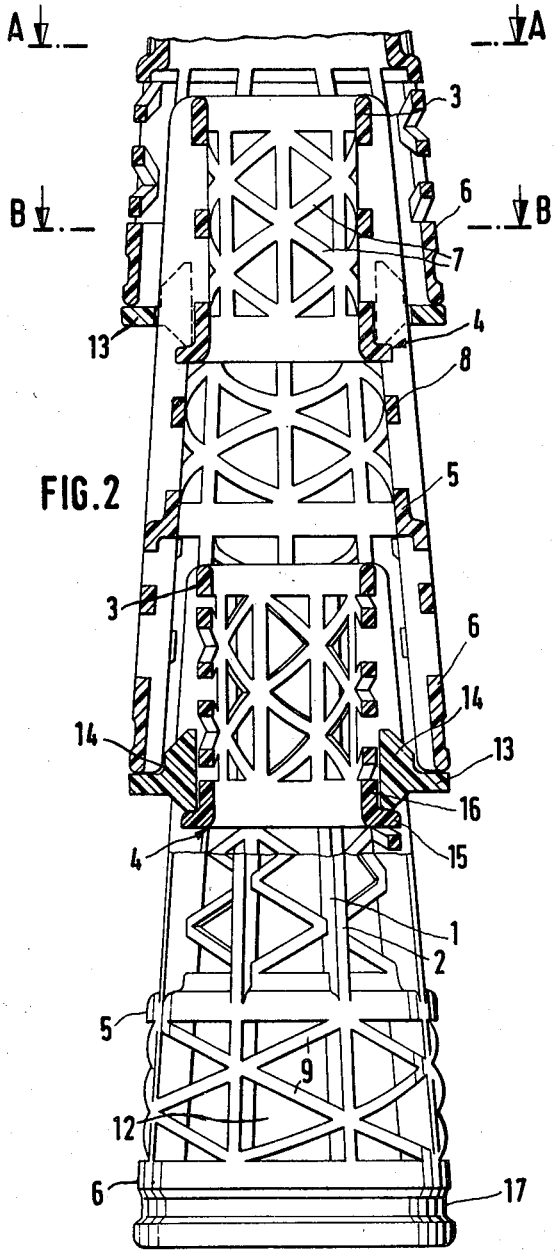
FIG. 2 is a vertical section through a plurality of yarn carriers according to FIG. 1 coaxially nested one within the other.
Figure 3:
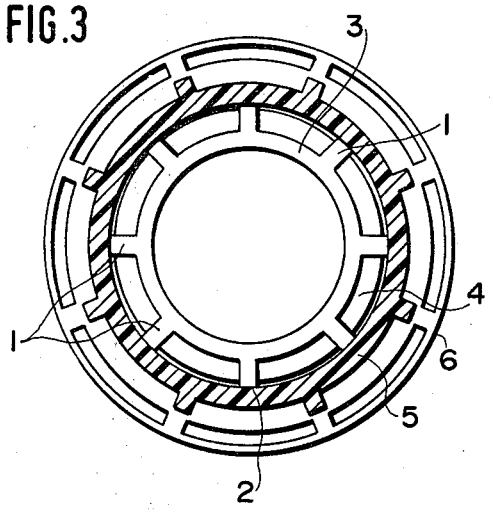
FIG. 3 is a horizontal cross section along the section line A—A in FIG. 2.
Figure 4:
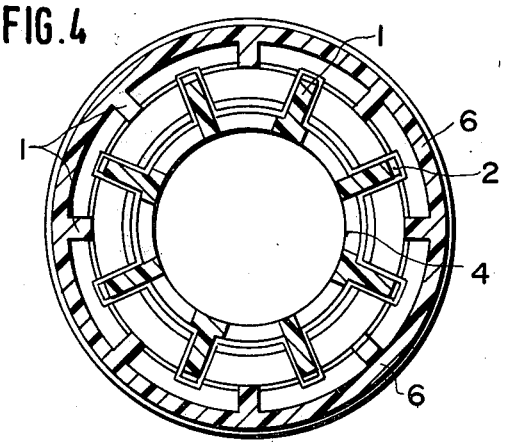
FIG. 4 shows a horizontal cross section along the line B—B of FIG. 2.

As is especially shown in FIG. 2, the just described construction of the yarn carrier according to the invention makes it possible, that a ring element 13 with radially inwardly extending projections 14 may be slipped or shifted over the portion of the yarn carrier located above the securing ring 4. The shiftability or adjustability of the ring element 13 is limited by a flange member 15 secured to a sleeve portion 16 of the securing ring 4. For this purpose the ring element 13 is dimensioned in such a manner that it comes to rest with its projections 14 on the flange member 15 of the securing ring 4. This type of construction exactly defines the nestability of a yarn carrier according to the invention with the aid of the ring element 13, whereby the projections 14 also assure that all yarn layers initially on the portion of the yarn carrier which is pushed into the following yarn carrier, are displaced onto the other, larger diameter portion, whereby these layers are uniformly densified with the layers already located on the larger diameter portion.

To facilitate the beginning of a winding operation, the radially outwardly facing surfaces of the rods 1, of the securing rings 5 and 6, and of the stiffening ribs 9 of the yarn carrier are roughened, whereby the first lap layer is prevented from sliding off.

The securing ring 6 is additionally provided with a ring groove 17 for the formation of a freely accessible thread reserve. This groove 17 merely insignificantly shortens the winding surface since the latter extends along the full height of the remainder of the yarn carrier.

According to the invention the radially outwardly facing surfaces which form the carrier surfaces, are rods arranged in a circle. The rods are held in position by securing rings arranged coaxially to the longitudinal yarn carrier axis and by diagonally extending stiffening ribs 7, 8, and 9. This structure results in a yarn carrier having an excellent inherent stiffness without the use of high strength materials in its manufacture.

Further, the securing ring member 4 which has a radially outwardly extending flange 15 and an axially extending sleeve 16 as best seen in FIG. 2, assures an exact limitation of the extent by which the yarn carriers according to the invention may be nested coaxially one within the other. The securing ring 4 is located approximately in the middle between the ends of the yarn carrier. Further, the securing ring 4 is so dimensioned that the projections 14 of the ring elements 13 come to rest on the flange 15, whereby said nesting limitation is assured.

Another advantage of the invention is seen in that the securing rings as well as the stiffening ribs do not hinder in any way whatsoever the coaxial nesting of the yarn carriers. This is accomplished according to the invention in that the rods 1 reach radially inwardly in the upper one third length of the yarn carrier beyond the securing rings and the stiffening ribs, whereas the rods 1 extend radially inwardly in the lower one third length of the yarn carrier and relative to the securing rings 5 and 6.

The above mentioned roughening of the radially outwardly facing surfaces 2 of the rods 1, of the securing rings, and of the stiffening ribs 9 in the lower zone of the yarn carrier and the provision of the ring groove 17 on the lower securing ring 6 makes it possible to use the present yarn carrier on standardized automatic winding machines.

The ring groove 17 can take up the thread reserve required for the initial winding operation which is even facilitated by the gripping traction of the roughened winding surface. Thus, the invention also provides the advantage that an unintended shifting of the first lap layer is prevented.

Yet another advantage is seen in the large openings 10 which in conjunction with the slots or channels 11 facilitate the flow of media used for the treatment of the yarn without, however, impairing the inherent stiffness of the present yarn carrier and without impairing its capacity of being efficiently wound with the yarn thread.

Although the invention has been described with reference to specific example embodiments, it will be appreciated, that it is intended to cover all modifications and equivalents within the scope of the appended claims.

What is claimed is:

1. A conical yarn thread carrier having a longitudinal axis and comprising carrier surface means (2) defined by a frustum jacket surface having a large diameter end and a small diameter end, radially extending openings (10) between said carrier surface means (2), slot means (11) uniformly distributed about the circumference of the yarn carrier, said slot means (11) extending approximately from the middle of the yarn carrier axially to its small diameter end, said slot means forming a portion of said openings, said yarn carrier further comprising stop ring means (13, 14) located on said carrier surface means (2), said stop ring means comprising radially outwardly extending means for receiving the large diameter end of another yarn carrier thereon, and radially inwardly extending projections (14) guided in said slot means (11), whereby said stop ring means is axially displaceable along said yarn carrier over the length of said slot means, means operatively positioned for limiting the axial displacement of said stop ring means (13, 14) to the length of said slot means between said small diameter end and said displacement limiting means, and means at said larger diameter end for the formation of a freely accessible thread reserve.

2. The yarn carrier according to claim 1, wherein said carrier surface means comprise rod means arranged in a circle and having radially outwardly extending surfaces, said yarn carrier further comprising securing ring means and stiffening rib means for holding said rod means, said securing ring means being arranged coaxially relative to said longitudinal axis, said stiffening rib means extending diagonally between said rod means.

3. The yarn carrier of claim 1, wherein said displacement limiting means comprise a holding ring member (4) having an angular cross-section with an axially extending sleeve (16) and with a flange (15) extending radially outwardly relative to said sleeve, said holding ring member being located approximately in the middle between the large and small diameter ends of the yarn carrier, said holding ring member being so dimensioned that said projections (14) of said stop ring means may rest on said radially extending flange.

4. The yarn carrier of claim 2, wherein said rod means extend radially outwardly in the upper one third of the length of the yarn carrier beyond said securing ring means and beyond said stiffening rib means, said rod means extending radially inwardly in the lower one third of the length of the yarn carrier beyond the securing ring means and beyond said stiffening rib means.

5. The yarn carrier of claim 2, wherein said securing ring means and said stiffening rib means in the lower one third of the length of the yarn carrier comprise a roughened surface and wherein said means for the formation of a thread reserve comprises ring groove means in the outer surface of the lowest one of said securing ring means.

* * * * *